US005363561A

United States Patent [19]

Essary

[11] Patent Number: 5,363,561

[45] Date of Patent: Nov. 15, 1994

[54] PILLOW TEMPLATE APPARATUS

[76] Inventor: Karen P. Essary, 6333 Lighthouse Rd., Monroe, Mich. 48161

[21] Appl. No.: 61,592

[22] Filed: May 17, 1993

[51] Int. Cl.[5] ..... G01B 3/14

[52] U.S. Cl. ..... 33/562; 33/1 G; 33/11

[58] Field of Search ..... 33/19, 1 F, 1 B, 2 R, 33/11, 14, 16, 17 A, 562, 563, 565, 566, 520; 83/565

[56] References Cited

U.S. PATENT DOCUMENTS

| | | | |
|---|---|---|---|
| 2,190,582 | 2/1940 | Wolf | 33/562 |
| 2,653,387 | 9/1953 | Cameron | 33/562 |
| 2,710,450 | 6/1955 | Stasinos | 33/1 F |
| 2,933,818 | 4/1960 | Palmer | 33/565 |
| 4,302,884 | 12/1981 | Pallone | 33/562 |
| 4,608,939 | 9/1986 | Lampley | 33/562 |
| 4,718,174 | 1/1988 | Masci | 33/562 |
| 4,945,642 | 8/1990 | Saulietis | 33/562 |
| 5,016,357 | 5/1991 | Leonard | 33/1 B |
| 5,052,118 | 10/1991 | Beitler | 33/1 B |
| 5,121,552 | 6/1992 | Cimador | 33/1 B |

FOREIGN PATENT DOCUMENTS

| | | | |
|---|---|---|---|
| 0070316 | 12/1949 | Denmark | 33/562 |
| 2396522 | 3/1979 | France | 33/562 |
| 1604737 | 12/1981 | United Kingdom | 33/562 |
| 2207848 | 2/1989 | United Kingdom | 33/566 |
| 2248855 | 4/1992 | United Kingdom | 33/19 |

*Primary Examiner*—Thomas B. Will
*Attorney, Agent, or Firm*—E. Michael Combs

[57] ABSTRACT

A plate structure is arranged for positioning medially of an underlying fabric pattern permitting severing of an associated fabric web relative to the fabric pattern to provide for the symmetrical removal of the pattern relative to the underlying fabric web.

4 Claims, 4 Drawing Sheets

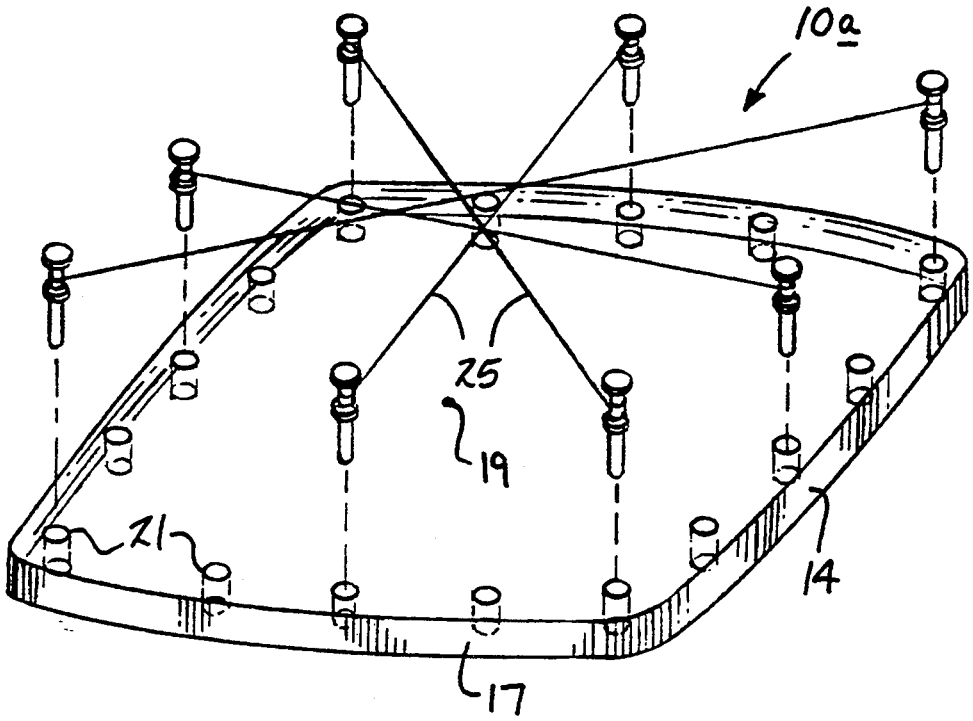
FIG. 3
FIG. 4
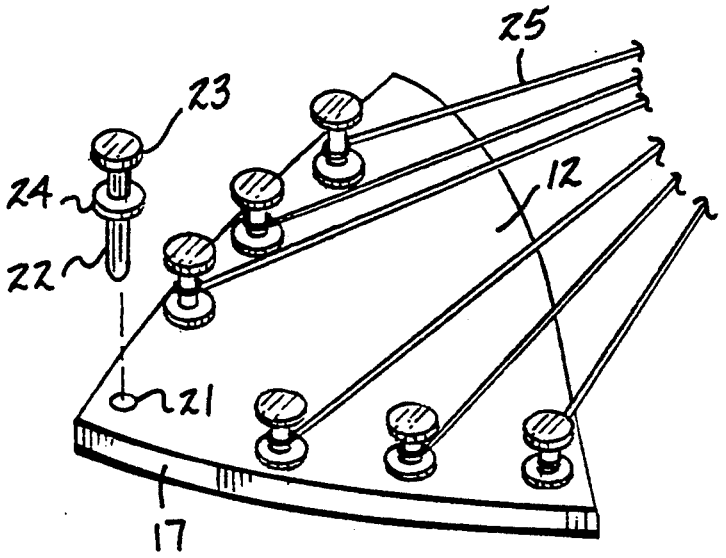

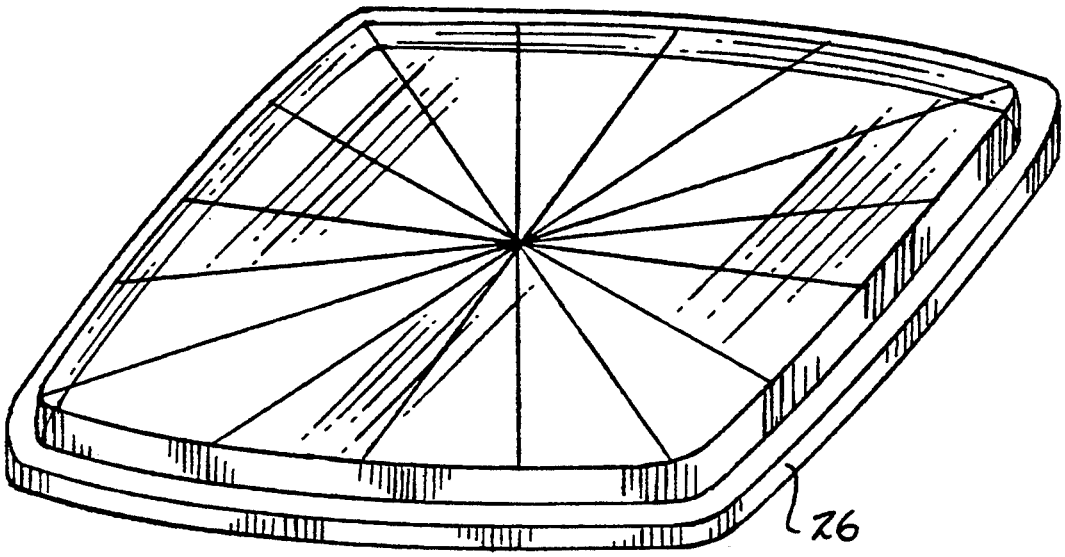
FIG. 5
FIG. 6
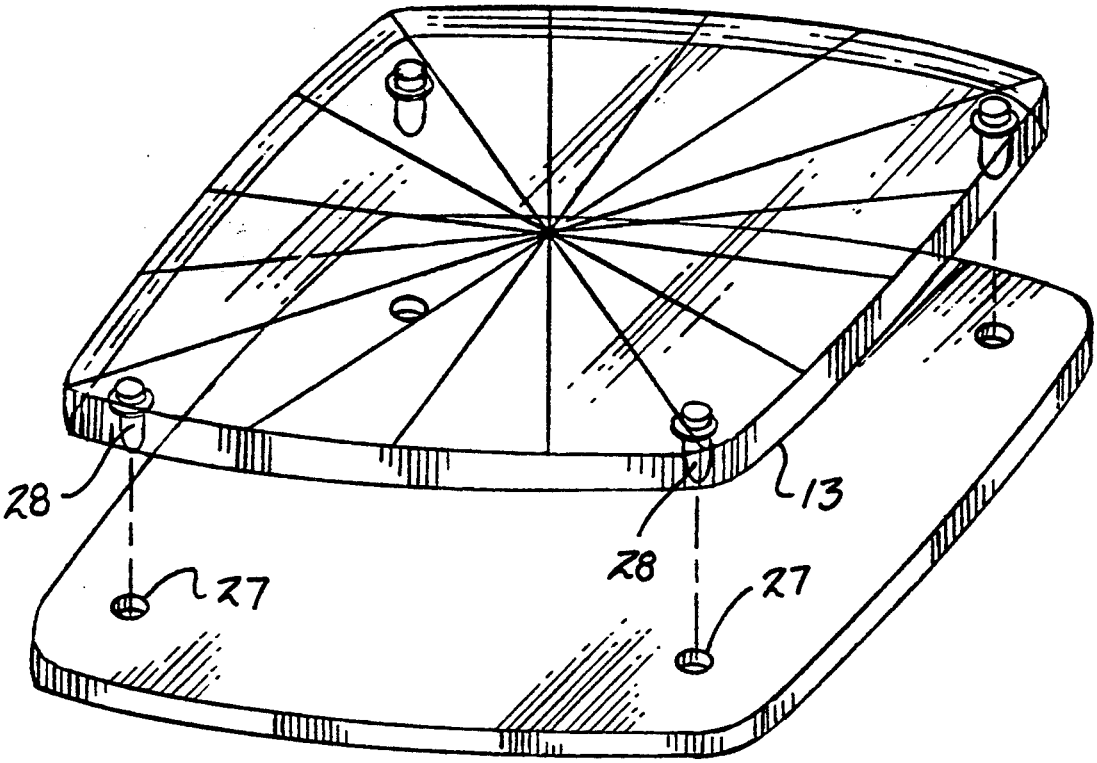

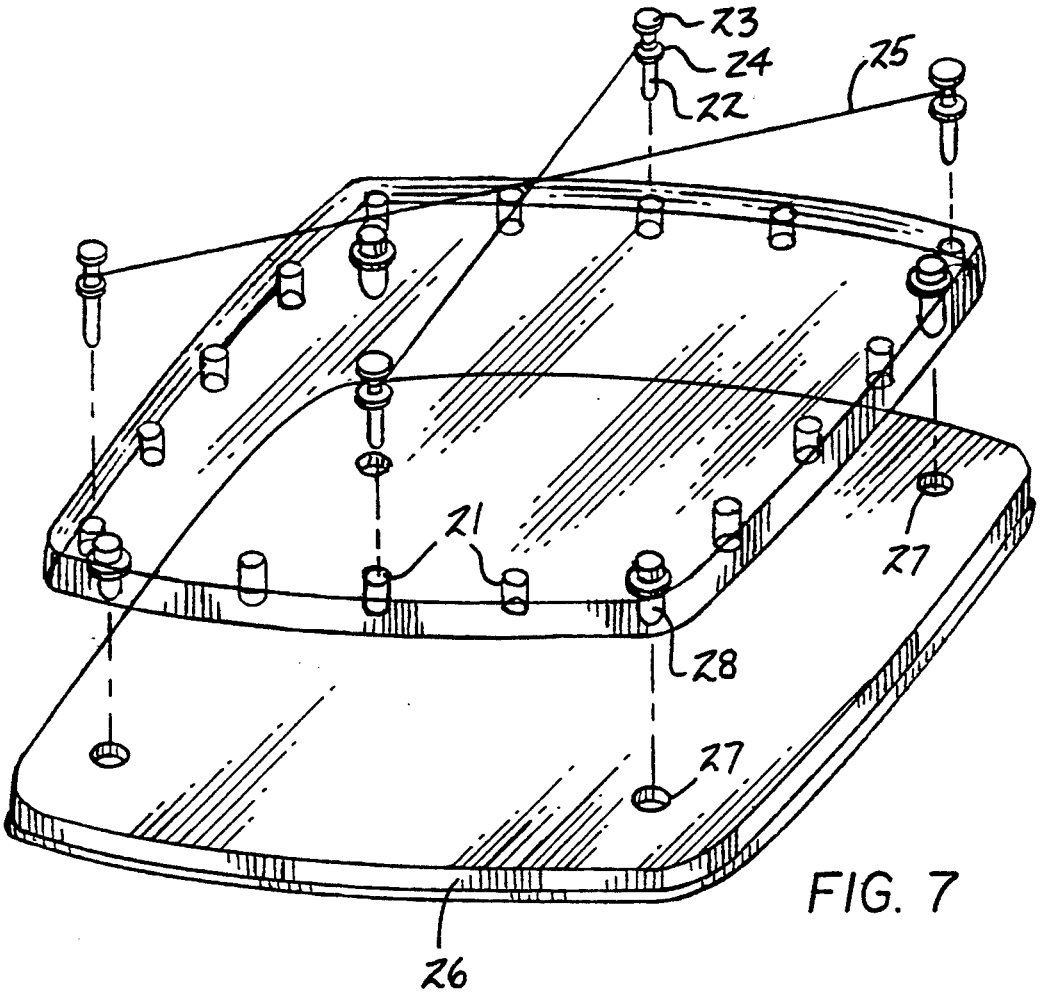
FIG. 7
FIG. 8
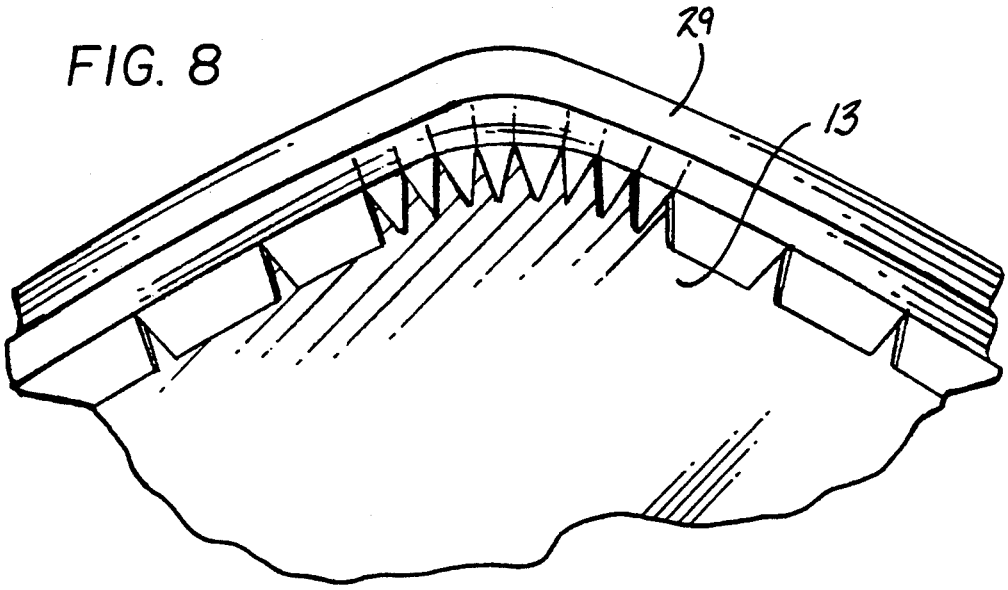

PILLOW TEMPLATE APPARATUS

BACKGROUND OF THE INVENTION

1. Field of the Invention

The field of invention relates to pillow construction, and more particularly pertains to a new and improved pillow template apparatus wherein the same is arranged for the severing of a fabric web for pillow construction while simultaneously orienting a pattern relative to the fabric web.

2. Description of the Prior Art

The cutting and removal of a web portion for construction of a pillow results in a non-uniform typical construction of the resultant pillow should the individual severing such a web not accommodate and provide for a convex side wall construction, whereupon stuffing the pillow permits a final resultant product of linear size. While the prior art, such as exemplified in U.S. Pat. Nos. 3,440,980; 4,930,382; 3,774,558; and 5,058,285 provides for various template structure relative to sewing procedures, the instant invention overcomes deficiencies of the prior art by providing for a template structure arranged for the specific severing of a web for the construction of a symmetrically oriented pillow and in this respect, the present invention substantially fulfills this need.

SUMMARY OF THE INVENTION

In view of the foregoing disadvantages inherent in the known types of template apparatus now present in the prior art, the present invention provides a pillow template apparatus wherein the same is directed to the desired positioning for subsequent severing of a web relative to pillow construction. As such, the general purpose of the present invention, which will be described subsequently in greater detail, is to provide a new and improved pillow template apparatus which has all the advantages of the prior art pillow construction and none of the disadvantages.

To attain this, the present invention provides a plate structure arranged for positioning medially of an underlying fabric pattern permitting severing of an associated fabric web relative to the fabric pattern to provide for the symmetrical removal of the pattern relative to the underlying fabric web.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pillow template apparatus which has all the advantages of the prior art pillow construction and none of the disadvantages.

It is another object of the present invention to provide a new and improved pillow template apparatus which may be easily and efficiently manufactured and marketed.

It is a further object of the present invention to provide a new and improved pillow template apparatus which is of a durable and reliable construction.

An even further object of the present invention is to provide a new and improved pillow template apparatus which is susceptible of a low cost of manufacture with regard to both materials and labor, and which accordingly is then susceptible of low prices of sale to the consuming public, thereby making such pillow template apparatus economically available to the buying public.

Still yet another object of the present invention is to provide a new and improved pillow template apparatus which provides in the apparatuses and methods of the price art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a modified aspect of the invention.

FIG. 4 is an enlarged isometric illustration of the alignment cables in association with registration rods.

FIG. 5 is an isometric illustration of the invention used with an underlying anvil plate.

FIG. 6 is an isometric illustration indicating the desired mounting of the anvil plate relative to the template structure.

FIG. 7 is an isometric illustration of the modified plate member in cooperation with the anvil plate.

FIG. 8 is an isometric illustration of the template plate having a continuous guard shield extending about the periphery of the template.

DESCRIPTION OF THE PREFERRED EMBODIMENT

Figure 1:
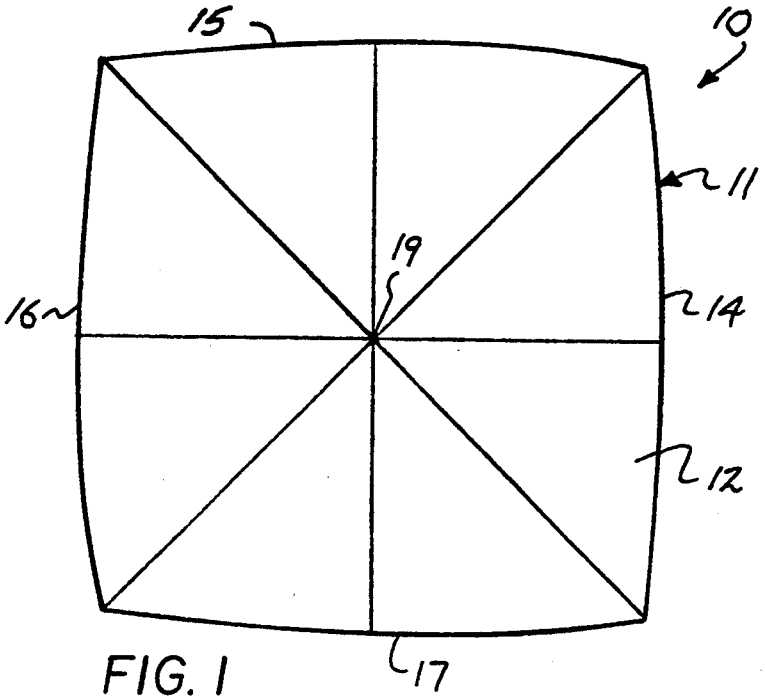
FIG. 1 is an orthographic view of the invention.
Figure 2:
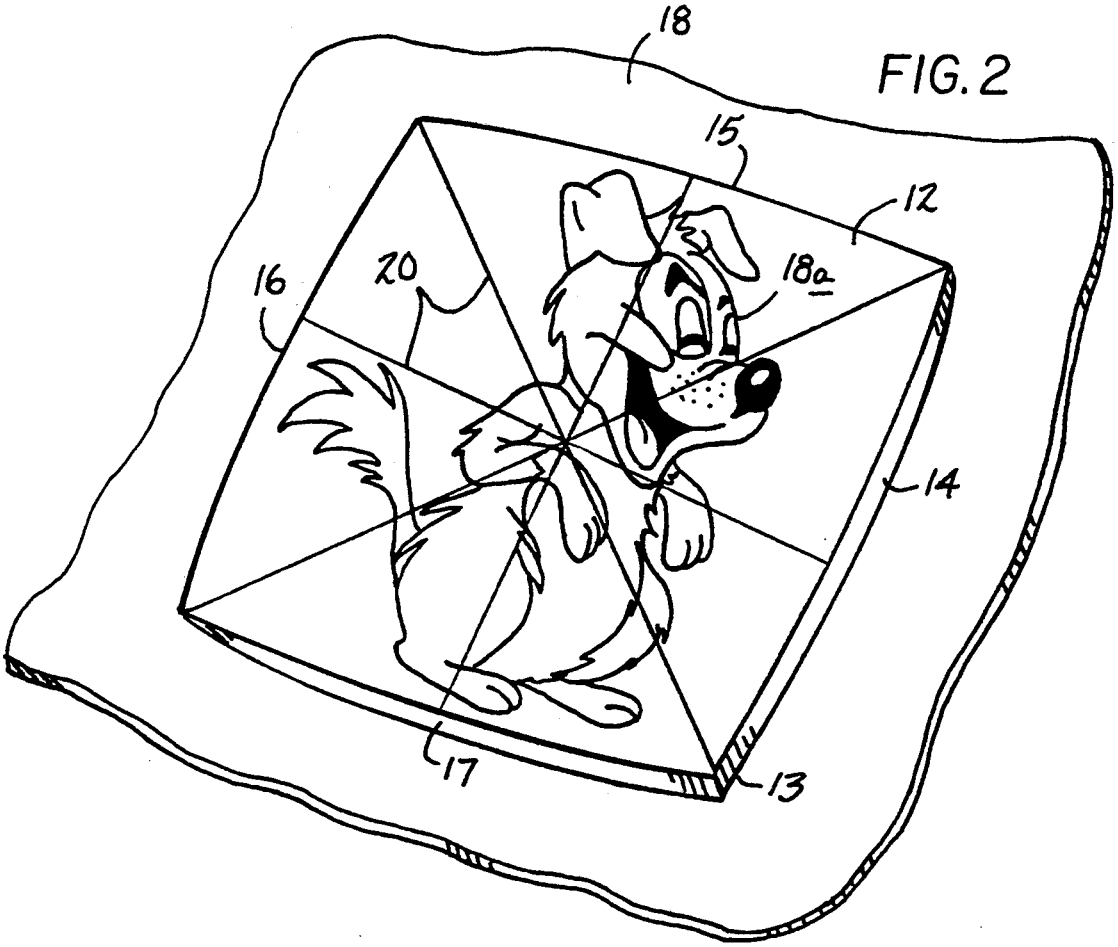
FIG. 2 is an isometric illustration of the invention in use.

With reference now to the drawings, and in particular to FIGS. 1 to 8 thereof, a new and improved pillow template apparatus embodying the principles and concepts of the present invention and generally designated by the reference numerals 10 and 10*a* will be described.

More specifically, the pillow template apparatus 10 of the instant invention essentially comprises a transparent rigid plate member 11, having a continuous side wall periphery, wherein the side wall periphery is orthogonally oriented relative to respective planar plate top and bottom walls 12 and 13. The continuous side wall includes a convex first side wall 14 extending to a convex second side wall 15, that in turn extends to a convex third side wall 16, and finally to a convex fourth side wall 17. An underlying fabric web 18 is indicated, having a pictorial representation 18*a* (see FIG. 2), wherein radial. linear alignment indicator rays 20 extend from each corner of the plate member towards a medial center 19, with at least one indicator ray extending medially of one of the side wales 14 through 17. In this manner, alignment of a pictorial presentation 18*a* relative to an underlying fabric web 18 is provided permitting severing of the web 18 along the continuous periphery side wall.

The FIG. 3 indicates a modified template plate member, having in adjacency to the continuous peripheral side wall, a continuous spaced array of registration bores 21 spaced apart an equal predetermined spacing such that at least one of the registration bores are positioned adjacent each corner of the template plate member, with further of said bores 21 and a plurality of such positioned along each of the side walls 14–17, such that a registration rod 22 is slidably received within an individual bore 21, with the registration rod 22 having a first flange 23 spaced from and parallel a second flange 24 about which a flexible cable 25 is wound, such that each cable 25 extends between a plurality of the registration rods 22. In this manner, re-orientation of crossed alignment cables 25 permits the alignment of a plurality of patterns upon the fabric web 18 in addition to having a medial center 19.

The FIGS. 5–8 indicates the further use of an anvil plate 26 of rigid construction upon which the template plate is positioned. The template to this end includes a plurality of plate member positioning rods 28, each of which is received within an individual anvil plate bore 27 within the anvil plate, to provide for selective fixed positioning of the anvil plate relative to the template plate. The FIG. 8 further includes a continuous metallic periphery shield 29 fixedly mounted in contiguous communication with the continuous peripheral side wall of the template plate, whereupon a cutting member (not shown) when directed along the shield 29 prevents damage to the template plate.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A template apparatus, comprising, a transparent rigid template member, having a continuous peripheral side wall orthogonally oriented relative to a planar top wall and a planar bottom wall of the template member, the peripheral side wall including a convex first side wall portion, a convex second side wail portion, a convex third side wall portion, and a convex fourth side wall portion, with each wall portion oriented at an oblique angle relative to one another, with the template member arranged for positioning upon a fabric web, and a medial center indicator oriented medially of the first and third side walls, and a plurality of registration bores orthogonally directed through the top wall and the bottom wall in adjacency to the peripheral side wall, with a plurality of said registration bores positioned in adjacency to each said side wall portion, and each registration bore of said registration bores including a registration rod, each said rod having a rod first flange and a rod second flange, with the rod second flange arranged for abutment of the top wait, and a flexible alignment cable extending between a plurality of registration rods, and including a plurality of pairs of said registration rods and a plurality of alignment cables to provide for intersection of a plurality of said cables for positioning of a pictorial representation upon said fabric web.

2. An apparatus as set forth in claim 1 including a rigid anvil plate, with the template plate member arranged for mounting upon the anvil plate.

3. An apparatus as set forth in claim 2 wherein the anvil plate includes a plurality of anvil plate bores, and the template member including a plurality of position rods orthogonally oriented relative to the bottom wall, with each position rod of said position rods arranged for reception within one of said anvil plate bores for fixedly mounting the anvil plate relative to the template member.

4. An apparatus as set forth in claim 3 including a continuous metallic shield mounted contiguously and coextensively to the peripheral side wall.

* * * * *